US010352122B2

(12) United States Patent
Swinford

(10) Patent No.: US 10,352,122 B2
(45) Date of Patent: Jul. 16, 2019

(54) DRILLING JAR

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 714 days.

(21) Appl. No.: 14/987,082

(22) Filed: Jan. 4, 2016

(65) Prior Publication Data

US 2017/0191329 A1 Jul. 6, 2017

(51) Int. Cl.
*E21B 31/107* (2006.01)
*E21B 31/18* (2006.01)
*C22C 9/01* (2006.01)

(52) U.S. Cl.
CPC ..... *E21B 31/107* (2013.01); *C22C 9/01* (2013.01); *E21B 31/18* (2013.01)

(58) Field of Classification Search
CPC ..... E21B 31/107; E21B 31/18; C22C 9/01
USPC ..... 166/301
See application file for complete search history.

(56) References Cited

U.S. PATENT DOCUMENTS 5,411,107 A * 5/1995 Hailey ..... E21B 31/113 166/301
5,906,239 A * 5/1999 Oettli ..... E21B 31/1135 166/178
8,151,910 B2 * 4/2012 Swinford ..... E21B 31/1135 166/178
2003/0010953 A1 * 1/2003 Coppock ..... F16K 3/22 251/326
2012/0148431 A1 * 6/2012 Gabriel ..... F16J 15/32 417/559

* cited by examiner

*Primary Examiner* — Matthew R Buck
*Assistant Examiner* — Patrick F Lambe
(74) *Attorney, Agent, or Firm* — Eric P. Mirabel, JD, LLM

(57) ABSTRACT

A jarring device for a coiled tubing of an oil well-bore is disclosed. A sliding assembly of the jarring device which is slideable within a barrel assembly includes a mandrel and a knocker. The barrel assembly comprises a fluid chamber. The fluid chamber includes an upper chamber, a restricted segment and a lower chamber. Further, a braking assembly is attached to the sliding assembly. The braking assembly includes a ring valve made of an alloy belonging to Aluminum-Bronze family of copper alloys, and which is capable of expanding when exposed to pressure. When the braking assembly is moved into restricted segment, and the fluid within the fluid chamber is compressed, flow of fluid through the restricted segment gets blocked due to expansion of the ring. When the braking assembly exits the restricted chamber, a sudden drop in pressure causes the knocker and/or the mandrel to strike the barrel assembly and generate a powerful jarring impact and shock wave.

20 Claims, 9 Drawing Sheets

DRILLING JAR

FIELD OF INVENTION

This invention relates to jarring device used for generating jarring impact, and especially, to jarring devices for coiled tubing in an oil well-bore.

BACKGROUND

Oil wells are generally formed by drilling a bore into the earth for accessing buried crude oil deposits, and then installing a variety of equipment within the bore to enable pumping of crude oil up to the earth's surface. During drilling, hollow metallic tubes (also known as 'casings') are inserted within the bore to prevent walls of bore from collapsing. In a deep enough bore, multiple hollow casings are installed vertically one above the other by screwing ends of adjacent sections with each other. The entire assembly of attached casings is commonly known as 'bore casing'.

Once a bore casing is formed, a variety of equipment (including crude oil pumping equipment and sensor equipment) is installed within the bore casing. In an operational oil well, crude oil is pumped to the surface of the earth from the buried crude oil deposits with the help of pumping equipment installed in the bore casing.

Performance and efficiency of an oil well production unit is vulnerable to failure of equipment installed within bore casing, or changed conditions within the well bore. Trouble-shooting of such problems often requires liberating (or setting free) stuck equipment or retrieval (or fishing) of equipment within the bore casing.

Liberation of a stuck equipment or its retrieval is often performed with coiled tubing, which rides out on a powered drum and down the bore casing. The coiled tubing often includes a drilling jar which is capable of providing a striking impact (or a shock wave) in both upwards and downwards directions, in order to free trapped equipment or tubing sections. See U.S. Pat. No. 8,151,910 (incorporated by reference). In an attempt to free stuck equipment or to separate it from the installed equipment assembly, the jarring device generates a striking impact which in turn generates a shock wave along the coil tubing, which travels to the stuck equipment.

Often, installed equipment within a well bore casing is held together by interlocking friction fittings. For successful separation of such installed equipment assembly, it is important that the jarring impact is strong enough to overcome resistance from such friction fittings.

Though currently known jarring devices claim to facilitate separation of desired equipment within a bore casing, their jar (or strike) generating mechanisms are often too weak to be effective. U.S. Pat. No. 8,151,910 (the '910 patent) discloses a jarring device which generates jarring impact by exerting either stretch or compression loading forces on a mandrel, followed by sudden release of the fluid pressure resisting either of these loading forces. However, in the jarring device of the '910 patent, the fluid continually leaks out of the region of resistant fluid compression during exposure to the loading forces. The resistant force is therefore reduced by leakage, and as a result, the jarring impact generated is weakened.

SUMMARY

The invention is a jarring device for coiled tubing that includes a braking assembly designed to completely block flow of fluid through a restricted segment and thereby provide enhanced resistance during loading, to generate a more forceful impact on release than the known jarring devices.

In the jarring device herein, a sliding assembly, which is slideable within a barrel assembly, includes a mandrel and a knocker. The knocker further has two striking surfaces, one which faces the upper sub, and the other facing the center sub. The barrel assembly (surrounding the sliding assembly) includes a fluid chamber which houses a compressible fluid. The fluid chamber has an upper chamber, a lower chamber, and a restricted segment between the upper chamber and the lower chamber. The braking assembly is attached to the sliding assembly and includes a ring valve which is made of an alloy belonging to Aluminum-Bronze family of copper alloys (a preferred embodiment primarily made of about 85% Cu, about 10.80% Al, and about 3.67% Fe, with optional preferred additives Mn (about 0.42%) and Ni (about 0.11%). The ring valve further includes at least three channels on each of its edges, where the channels extend into the ring and terminate inside the ring. Other channel designs are also contemplated.

The braking assembly is designed to completely block flow of fluid through the restricted segment when the ring is positioned in the restricted segment. In such position, when there is an influx of compressed fluid into the channels, the body of the ring expands and seals the flow of fluid through the restricted segment.

During down-stroke, the sliding assembly is pushed through the barrel assembly and the braking assembly passes through the restricted segment towards the lower chamber. Compressible fluid is forced through the channels in the lower face of the braking assembly ring, and the ring swells and stops flow through the restricted segment. Again, as soon the ring exits the restricted segment a flow path for the compressed fluid to flow towards the upper chamber becomes available, and there is a sudden drop in the resistant pressure, causing the knocker to accelerate towards and collide with the center sub, and the mandrel to collide with the upper surface of the upper sub. The preferred sliding assembly also includes a flange positioned below the ring which moves with the sliding assembly and collides with the upper edge of a lower sub (which the barrel assembly is connected with).

During up-stroke, the sliding assembly is pulled (by pulling the mandrel) through the barrel assembly, and the braking assembly, which starts in the lower chamber, is pulled into the restricted segment. The movement of the braking assembly ring against the resistance of the compressible fluid which is positioned on the side towards the upper chamber, causes swelling of the ring and stops fluid flow through the restricted segment. As soon as the ring exits the restricted segment, a flow path for the compressed fluid to flow through the restricted segment and towards the lower chamber becomes available, and there is a sudden drop in the resistance of the compressed fluid, and the knocker accelerates towards and collides with the upper sub. The preferred sliding assembly also includes a flange positioned below the center sub which moves with the sliding assembly and collides with the lower edge of the center sub.

The embodiments jarring device provided by the present invention will be discussed in greater detail with reference to the accompanying figures in the detailed description which follows.

Figure 1:
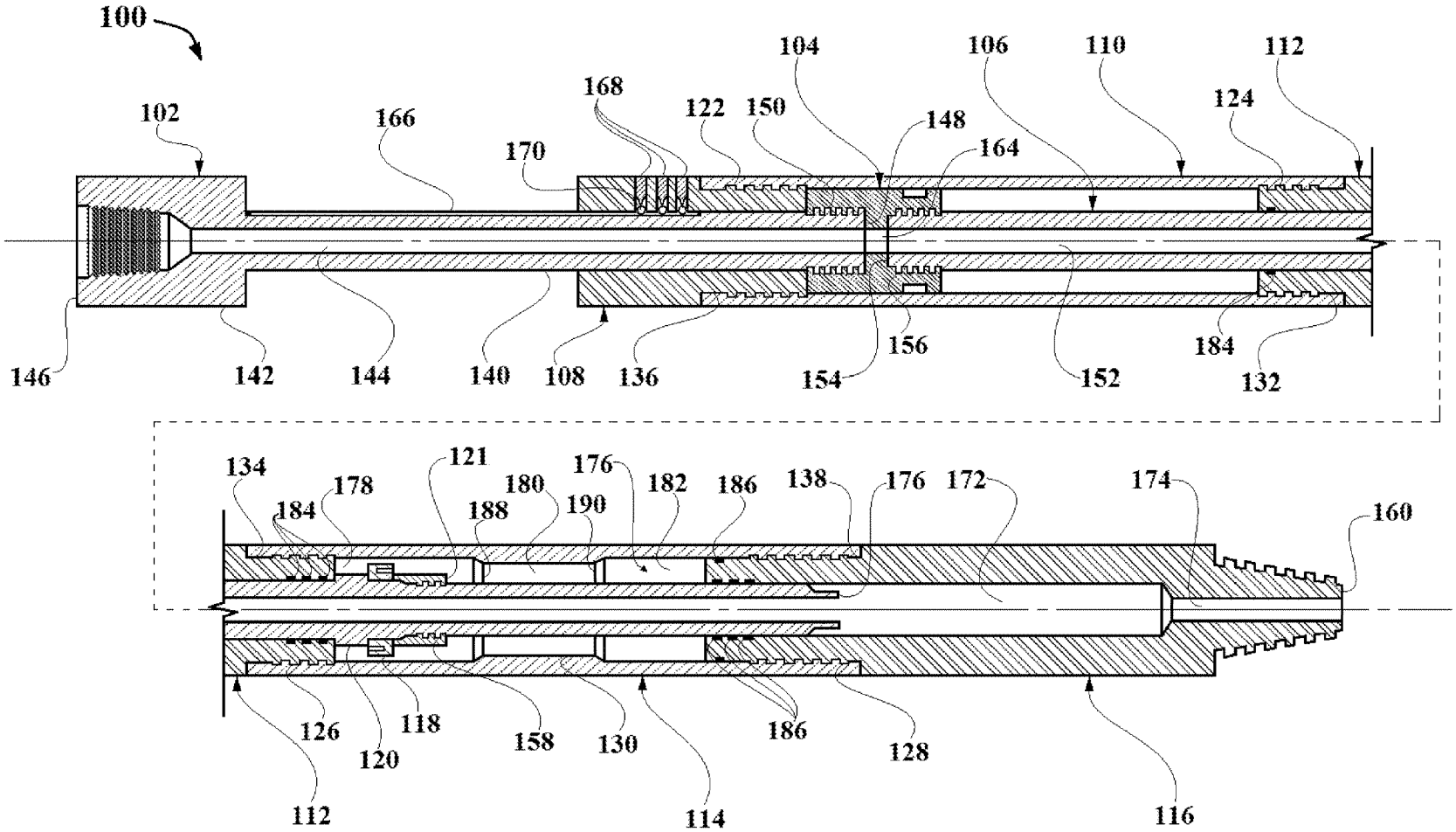
FIG. 1 is a cross-sectional view of a jarring device of the invention.

It should be understood that the drawings and the associated descriptions below are intended and provided to illustrate one or more embodiments of the present invention, and not to limit the scope of the invention. Also, it should be noted that the drawings are not be necessarily drawn to scale.

DETAILED DESCRIPTION

Reference will now be made in detail to a first embodiment of a jarring device of the invention with reference to the accompanying FIGS. 1, and 2A-2E, which illustrate a first embodiment of the present invention during up-stroke and FIGS. 3A-3E and illustrate it during down-stroke. As illustrated in these figures, jarring device 100 comprises a mandrel 102, a knocker 104, a wash-pipe 106, an upper sub 108, an upper barrel 110, a center sub 112, a lower barrel 114, a lower sub 116, a ring valve 118, a wash-pipe mounted wash-pipe upper flange 120 and a lower flange 121. The mandrel 102, the knocker 104, and the wash-pipe 106 together form a longitudinal sliding assembly which is slideable within barrels 110 and 114, and relative to the upper sub 108, the center sub 112 and the lower sub 116.

Upper barrel 110 and lower barrel 114 are internally threaded at portions proximate to each of their respective ends (shown as portions 122, 124, 126 and 128). A portion of lower barrel 114 has increased wall thickness (shown as portion 130) and reduced internal diameter compared to the other regions of lower barrel 114. Center sub 112 comprises two externally threaded arms 132 and 134. To form the barrel assembly, internally threaded portion 124 of the upper barrel 110 is screwed on to arm 132, and internally threaded portion 126 of the lower barrel 114 is screwed onto arm 134 of the center sub 112. Still further, internally threaded portion 122 of the upper barrel 110 is screwed onto externally threaded arm 136 of upper sub 108, and internally threaded portion 128 of the lower barrel 114 is screwed onto externally threaded arm 138 of lower sub 116. Each of the upper sub 108, the center sub 112, and the lower sub 116 further include a longitudinal cylindrical bore, and all three bores are aligned along a longitudinal axis of the barrel assembly so as to provide a passage for the sliding assembly to slide through. While the longitudinal cylindrical bore of the upper sub 108 provides a passage for sliding cylinder 140 of mandrel 102 to slide through, the longitudinal cylindrical bores of the center sub 112 and the lower sub 116 provide passage for wash-pipe 106 to slide through.

Mandrel 102 includes sliding cylinder 140, an outer cylinder 142 and a longitudinal bore 144 extending through the sliding cylinder 140 and the outer cylinder 142. The portion of the longitudinal bore 144 which lies in the outer cylinder 142 widens towards end 146 of the outer cylinder and is internally threaded for connecting the jarring device 100 to coiled tubing (shown in FIG. 7). Further, the portion of the sliding cylinder 140 which lies proximate to its end 148 is externally threaded (shown as externally threaded portion 150 in FIG. 1).

The wash-pipe 106 includes a longitudinal bore 152. The portion of the wash-pipe 106 which lies proximate to its end 154 is externally threaded (shown as portion 156 in FIG. 1). Further, wash-pipe 106 also includes a wash-pipe upper flange 120 and a threaded region 158 for connecting lower flange 121. The wash-pipe upper flange 120 is preferably formed as a region of increased wall thickness of the wash-pipe 106. A ring valve 118 is held between the wash-pipe upper flange 120 and the lower flange 121. Lower flange 122 is screwed on the threaded region 158 to hold the ring valve 118 in place. The wash-pipe upper flange 120, the ring valve 118 and the lower flange 121 together form a braking assembly for the jarring device 100. The ring valve 118 is preferably a tubular ring made of an alloy belonging to Aluminum-Bronze family of copper alloys, and preferably has a material composition of Cu (preferably about 85%), Al (preferably about 10.80%), Fe (preferably about 3.67%), with preferred additives: Mn about 0.42% and Ni 0.11%. The ring valve 118 slides freely along the steel innards of jar 100 without causing metal on metal scoring. A detailed illustration of ring valve 118 is shown in FIGS. 4A-4C.

Figure 4A:
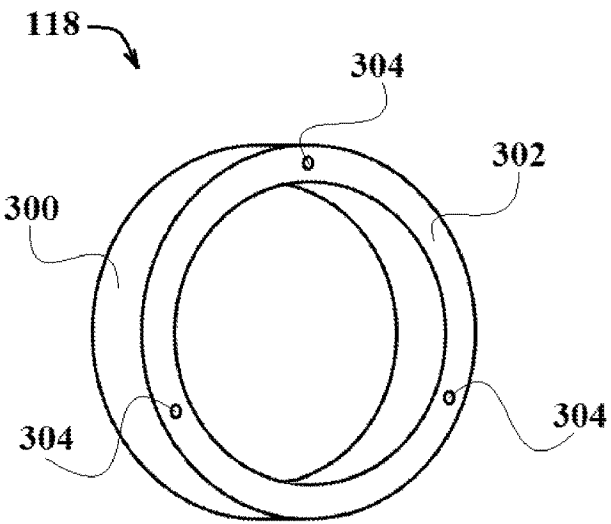
FIG. 4A is a perspective view of a first embodiment of a ring valve of the present invention
Figure 4B:
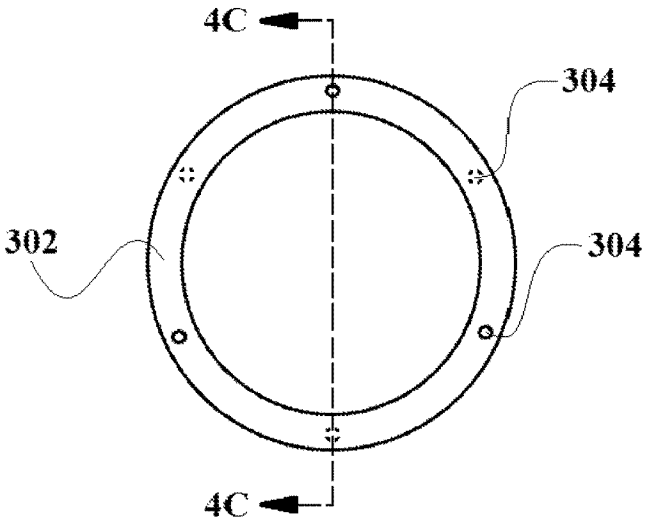
FIG. 4B is an elevational view of one side of the first embodiment of the ring valve.
Figure 4C:
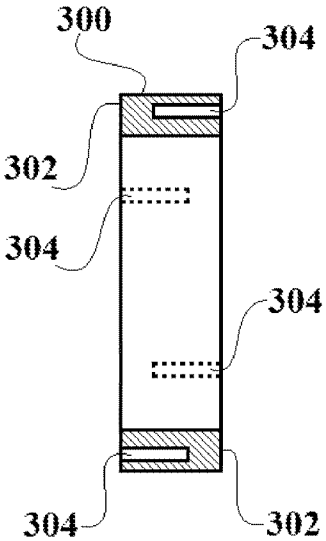
FIG. 4C is a cross-sectional view of the first embodiment of the ring valve taken along the lines 4C-4C of FIG. 4B.

While FIG. 4A illustrates a perspective view of the ring valve 118, FIGS. 4B and 4C illustrate its front view and cross-sectional side view respectively. As illustrated in FIGS. 4A-4C, the ring valve 118 includes a curved outer surface 300 and two edge surfaces 302. Each edge surface 302 preferably includes three axially extending channels 304 (more or fewer channels can be used). All six axially-extending channels 304 are distributed symmetrically about an axis of the ring valve 118, and terminate within the ring valve 118. Preferably, each of six axially-extending channels 304 extend about half of the length of the ring valve 118.

The outer diameter of the ring valve 118 is greater than the outer diameter of the wash-pipe upper flange 120 and the outer diameter of the lower flange 121. Further, each of the six axially extending channels 304 are preferably placed, when mounting the ring valve 118, such that their entrances are not blocked either by the wash-pipe upper flange 120 or by the lower flange 121. The outer diameter of the ring valve 118 is only slightly less (preferably, within $1/1000^{th}$ of an inch less) than the inner diameter of portion 130 of the lower barrel 114 such that when the ring valve 118 is placed within the portion 130 (by pushing the mandrel 102 into the upper sub 108 and sliding wash-pipe 106 away from the upper sub 108), the surface 300 conforms and fits tightly within portion 130.

Referring back to FIG. 1, knocker 104 is a hollow cylinder which is internally threaded at both ends. While one end of the knocker 104 is screwed on externally threaded portion 150 of the sliding cylinder 140, its opposite end is screwed on threaded portion 156 of the wash-pipe 106. A longitudinal bore 164 runs along the center of knocker 104.

Figure 2A:
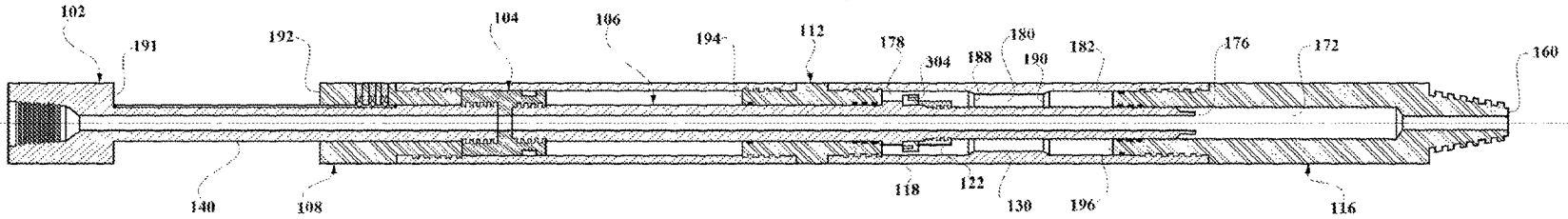
FIG. 2A-2E are cross-sectional views of orientations of a jarring device of the invention during various stages of down-stroke operation.
Figure 2B:
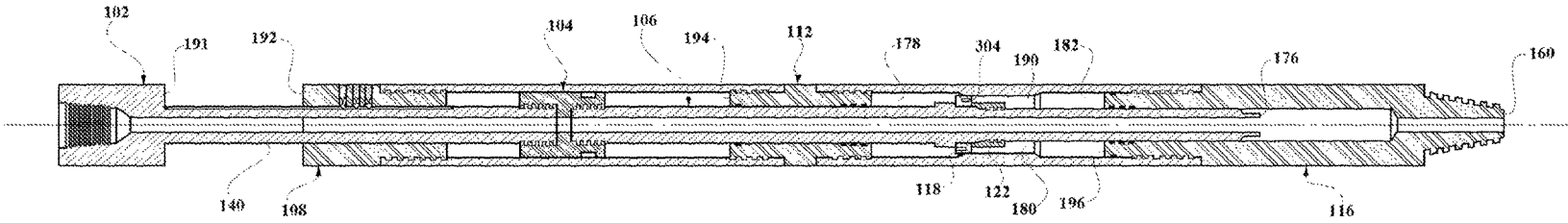
Figure 2C:
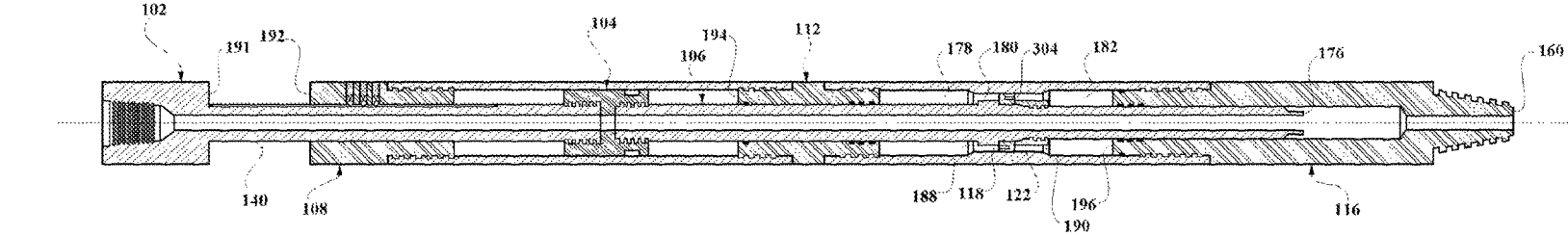
Figure 2D:
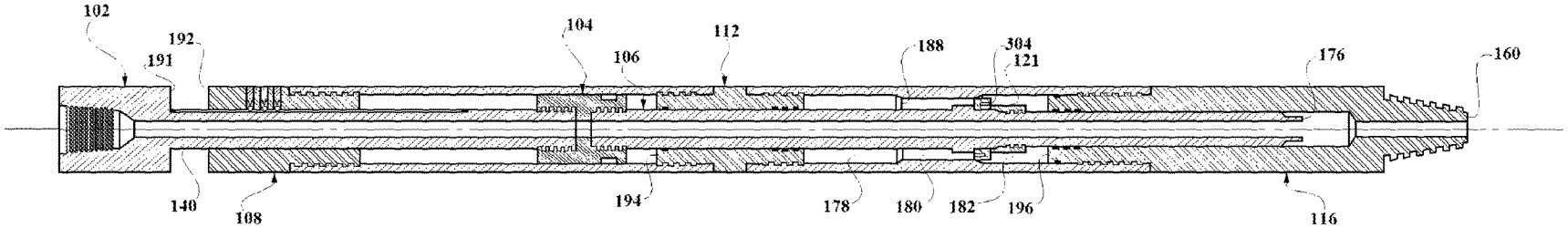
Figure 2E:
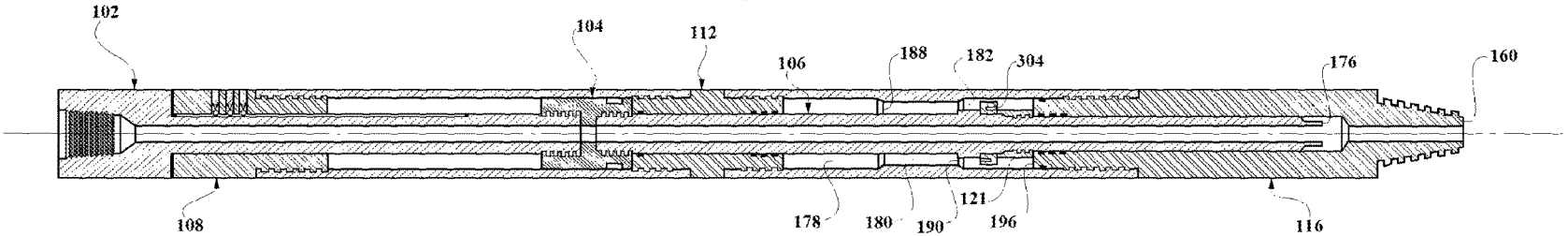

One exemplary position of the sliding assembly within the barrel assembly is shown in FIG. 2A. Sliding cylinder 140 slideably fits into the longitudinal bore of upper sub 108, and wash-pipe 106 slideably fits into the longitudinal bores within center sub 112 and lower sub 116. To prevent a relative circumferential rotation between the sliding assembly and the barrel assembly (or to prevent the sliding assembly from rotating on its axis within the barrel assembly), a grooved spline 166 is formed on sliding cylinder 140. One or more corresponding male mating members for grooved spline 166 are formed in upper sub 108. Exemplary male mating members are a set of screw 168 and a ball 170. Vertically adjustable screw 168 is positioned to fit the corresponding ball 170 at least partially within the grooved spline 166.

Lower sub 116 further includes a bore 174 as well as an externally threaded tapered arm 160. The narrower bore 174 is connected to the longitudinal bore 172 and lies along the longitudinal axis of the barrel assembly.

In the assembled jarring device 100, end 176 of wash-pipe 106 lies within the longitudinal bore 172 of lower sub 116. The longitudinal bore 144, bore 164, longitudinal bore 152, longitudinal bore 172 and narrow bore 174 together provide a fluid flow path for a fluid (flowing along the coil tubing) to pass through jarring device 100. The externally threaded tapered arm 160 is used to connect the jarring device 100 to lower portions of the coiled tubing which extends towards bottom of the oil well-bore. Lower portions of the coiled tubing would preferably include a fishing tool (such as an overshot) as described below and shown in FIG. 7.

Referring back to FIG. 1, the assembled jarring device 100 further includes a fluid chamber 176 bound by lower barrel 114, wash pipe 106, center sub 112 and lower sub 116. Fluid chamber 176 comprises an upper chamber 178, a restricted segment 180 and a lower chamber 182. Fluid chamber 176 is filled with a compressible fluid, preferably Xiameter™ PMX-200 (Dow Corning, Inc.), which is a silicone fluid, though other compressible fluids can be used. To prevent leakage of the compressible fluid contained in the fluid chamber 176, seals 184 are provided at the center sub 112 for sealing the interface of wash-pipe 106 and the center sub 112. Similarly, seals 186 are provided at the lower sub 116 for sealing the interface of wash-pipe 106 and the lower sub 116.

Operation of the jarring device 100 for producing jarring impact during down-stroke will now be explained in detail with reference to FIGS. 2A-2E. As illustrated in FIG. 2A, to initiate a down-stroke, the mandrel 102 is pushed into the barrel assembly through upper sub 108. As sliding cylinder 140 moves in, the wash-pipe 106 starts moving away from upper sub 108 (so end 176 of wash-pipe 106 starts moving deeper into bore 172). Due to gradual advancement of the wash-pipe 106, the ring valve 118 (along with the braking assembly) enters the restricted segment 180 through edge 188. Since the outer diameter of the ring valve 118 fits tightly within restricted segment 180, as ring valve 118 slides into the restricted segment 180, it starts compressing the compressible fluid contained within restricted segment 180 and lower chamber 182. This also causes pressurized fluid to flow into the channels 304 (FIGS. 4A-4C) of ring valve 118, which face the lower chamber 182. As the braking assembly slides towards the lower chamber 182 and the internal pressure increases, the ring valve 118 expands and completely seals its interface with the inner diameter of segment 180, and stops passage of fluid through segment 180. Once the interface between the ring valve 118 and portion 130 becomes sealed, further pushing of the mandrel 102 (and hence the wash-pipe 106) requires increasing force to overcome resistant compression pressure being generated by the compressed fluid. As the wash-pipe 106 continues to move away from the upper-sub 108 (and the compression pressure keeps increasing), there comes a stage when entire ring valve 118, having traversed through restricted segment 180, emerges out of edge 190. As soon as the ring valve 118 emerges out of edge 190, a flow path becomes available for the compressed fluid to escape from compression zone (which at this stage is the lower chamber 182) by flowing around the periphery of ring valve 118 towards the low pressure zones now in the restricted segment 180 and upper chamber 178. There is a sudden drop in the resistant pressure on mandrel 102. As a result, movement of entire sliding assembly gets accelerated, until end 191 of outer cylinder 142 (of mandrel 102), knocker 104 and the lower flange 121 collide with, respectively, end 192 of the upper sub 108, end 194 of center sub 112 and end 196 of the lower sub 116, generating a powerful jarring impact.

Figure 3A:
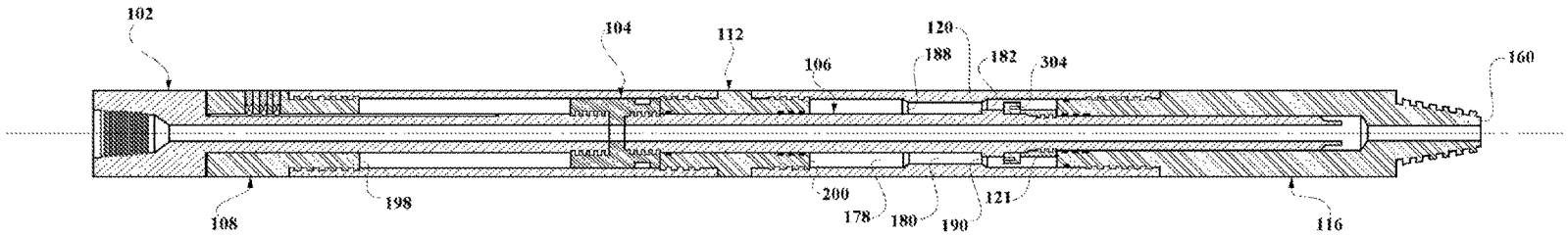
FIG. 3A-3E are cross-sectional views of orientations of the jarring device of the invention during various stages of up-stroke operation.
Figure 3B:
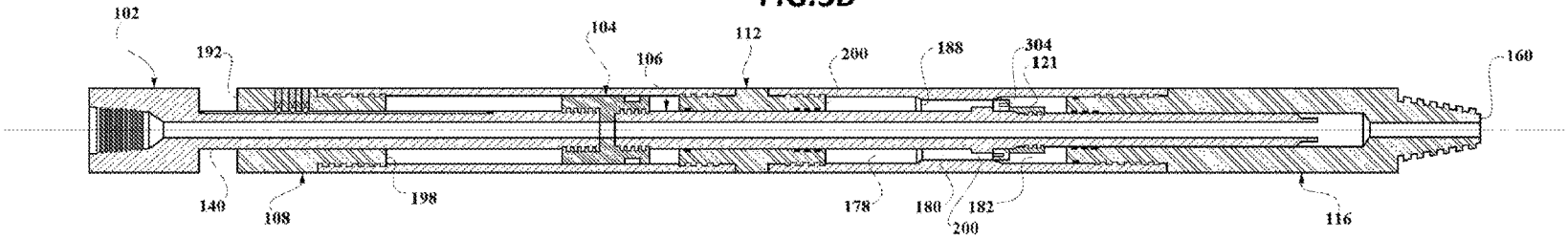
Figure 3C:
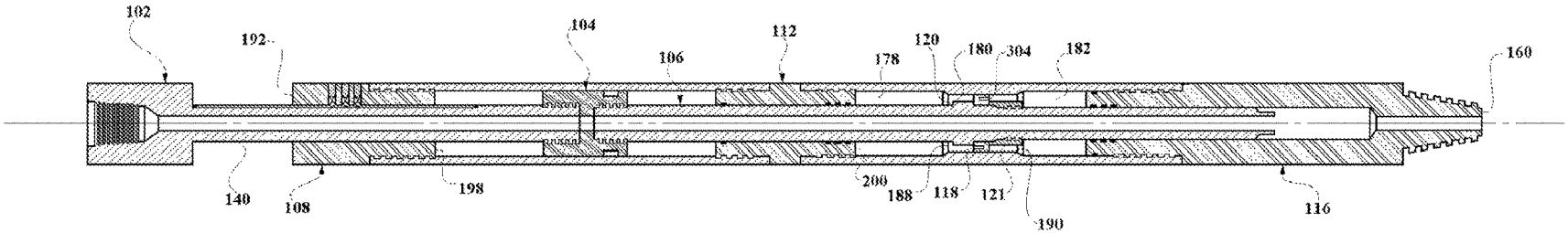
Figure 3D:
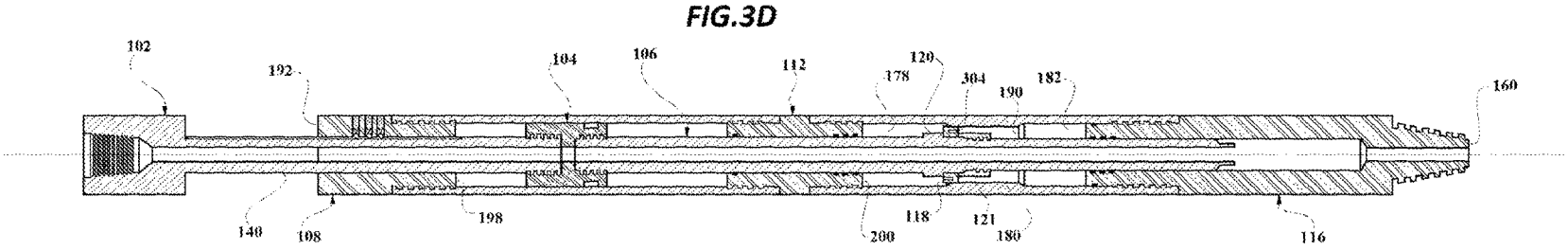
Figure 3E:
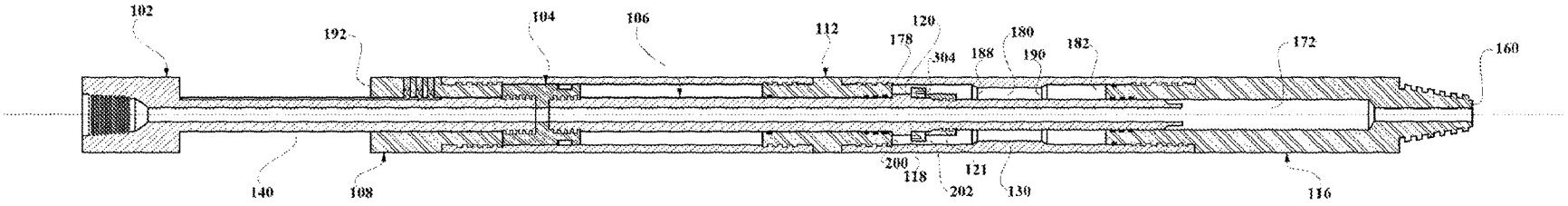

Operation of the jarring device 100 for producing jarring impact during up-stroke will now be explained in detail with reference to FIGS. 3A-3E. As illustrated in FIG. 3A, to initiate an up-stroke, the mandrel 102 is pulled out of the barrel assembly through the upper sub 108. As the sliding cylinder 140 moves out, the wash-pipe 106 starts moving towards the upper sub 108. Due to gradual advancement of the wash-pipe 106, the ring valve 118 (along with the braking assembly) enters the restricted segment 180 through edge 190. Since the outer diameter of the ring valve 118 tightly fits the inner diameter of restricted segment 180, it starts compressing the compressible fluid contained within restricted segment 180 and upper chamber 178. Again, the increasing pressure on up-stroke causes ring valve 118 to expand and seal against the inner diameter of segment 180. As wash-pipe 106 continues to move towards upper sub 108 (and the compression pressure keeps increasing), there comes a stage when ring valve 118, having traversed through restricted segment 180, emerges out of edge 188. As soon as ring valve 118 emerges out of edge 188, resistant pressure drops, and the sliding assembly accelerates upwardly. The knocker 104 and the wash-pipe upper flange 120 collide with, respectively, end 198 of upper sub 108 and end 200 of center sub 112, with a powerful jarring impact.

To frequently produce such series of jarring impacts, it is required that ring valve 118 slides smoothly within restricted segment 180, which also reduces wear on the contact surfaces. Low friction surface of ring valve 118 and its material composition (i.e. alloy composition having Cu about 85%, Al about 10.80%, Fe about 3.67%, Mn about 0.42% and Ni 0.11%) provides for these requirements. Ring valve 118 has excellent resistance to wear and fatigue under shock and load. Other embodiments of ring valve 118 are also within the scope of the invention. Two such embodiments are shown in FIGS. 5A-5C and 6A-6C.

Figure 5C:
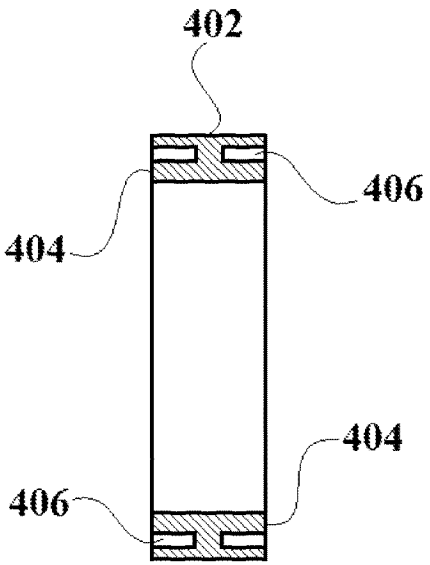
FIG. 5C is a cross-sectional view of the second embodiment of the ring valve taken along the lines 5C-5C of FIG. 5B.
Figure 5B:
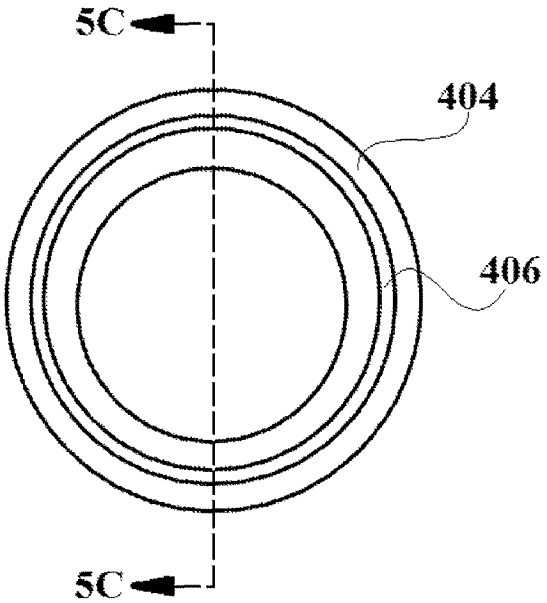
FIG. 5B is an elevational view of one side of the second embodiment of the ring valve.
Figure 5A:
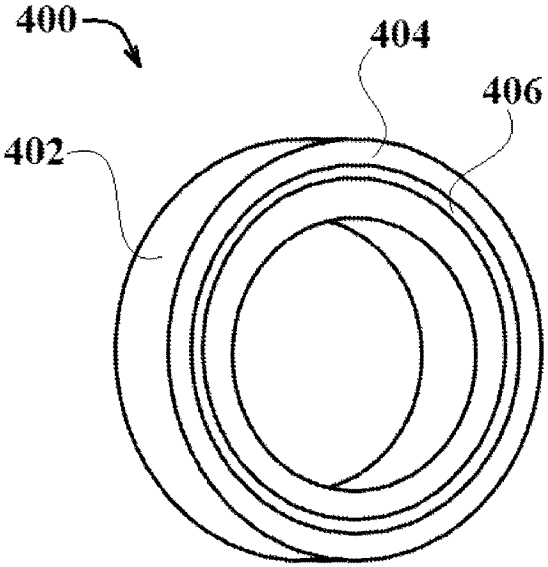
FIG. 5A is a perspective view of a second embodiment of a ring valve of the present invention.

Referring to FIG. 5A-5C a ring valve 400 made of an alloy belonging to Aluminum-Bronze family of copper alloys, and preferably having a material composition of Cu about 85%, Al about 10.80%, Fe about 3.67%, Mn about 0.42% and Ni 0.11% includes a curved outer surface 402 and two edge surfaces 404. Each edge surface 404 further includes an annular channel 406, which extends into the body of ring valve 400, but are not connected to each other. Functionally, during up-stroke followed by down-stroke of jarring device 100, the compressed fluid would exert pressure first on one annular channel 406 (then on the other) and would force the periphery of ring valve 400 to expand and completely seal the flow of fluid through the restricted segment 180. Ring valve 400 may expand more at considerably less compression pressure than ring valve 118.

Figure 6C:
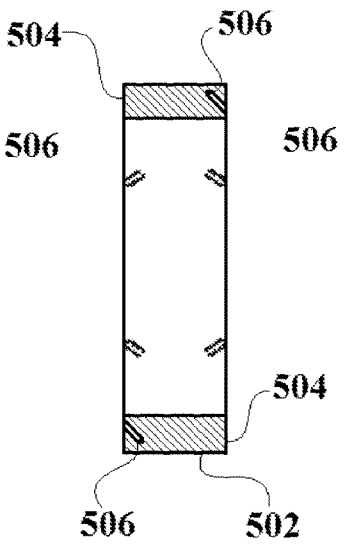
FIG. 6C is a cross-sectional view of the third embodiment of the ring valve taken along the lines 6C-6C of FIG. 6B.
Figure 6B:
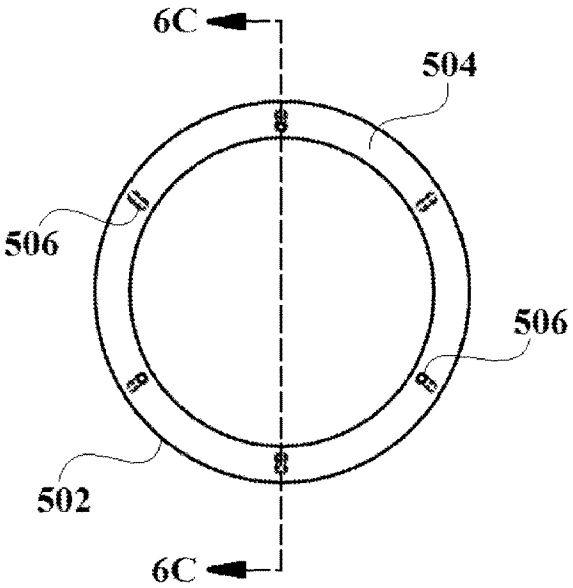
FIG. 6B is an elevational view of one side of the third embodiment of the ring valve.
Figure 6A:
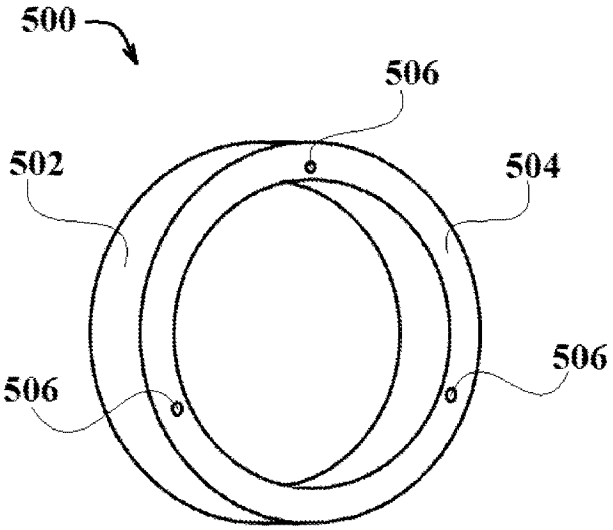
FIG. 6A is a perspective view of a third embodiment of a ring valve of the present invention.

Similarly, FIG. 6A-6C illustrate a modified ring valve 500. Ring valve 500 is also made of an alloy belonging to Aluminum-Bronze family of copper alloys, and preferably has a material composition of Cu about 85%, Al about 10.80%, Fe about 3.67%, Mn about 0.42% and Ni 0.11%. Each edge surface 504 preferably includes three non-axially extending channels 506 (more or fewer channels can be used). All six non-axially extending channels 506 extend towards curved outer surface 502 at an angle of about 45°. Further, all six non-axially extending channels 506 are distributed symmetrically about an axis of the ring valve 500, and terminate within the ring valve 500. Its operation with jarring device 100 is essentially the same as for ring valve 118 and 400.

Various other types of ring valves which would be suitable for being used in embodiments of the present invention would be obvious to a person skilled in the art. As an additional example another ring valve type could be a modification of the second type of ring valve 400 as described above. The modified version could additionally include multiple non-axially oriented sub-channels branching from each annular channel 406. During down-stroke or up-stroke, presence of such sub-channels would provide deeper penetration of compressed fluid within the ring valve and would likely enhance the expansion of ring valve's periphery. As a result of improved expansion, a better sealing for blocking flow of compressed fluid through restricted segment is achieved, resulting in a greater jarring impact. It is to be noted that ring valves used in embodiments of the present invention are made of alloys belonging to Aluminum-Bronze family of Copper alloys. Though Cu and Al are major constituents of such alloys, other minor additives may also be included to provide specific properties. As an example, and as mentioned above, in the first embodiment of present invention described above, apart from Cu and Al, the alloy forming ring valve 118 further includes Fe, Mn and Ni.

Figure 7:
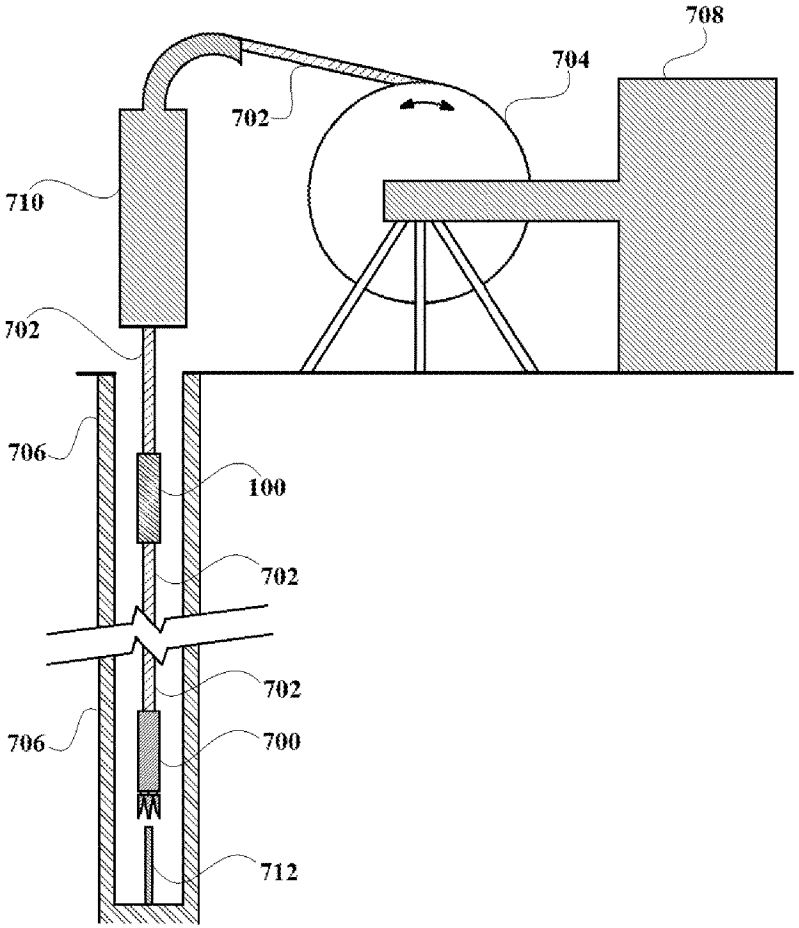
FIG. 7 illustrates a coil tubing set up for fishing including a jarring device of the present invention.

Use of jarring device 100 with a coil tubing for fishing of stuck equipment from an oil well-bore will now be explained with reference to accompanying FIG. 7. As illustrated, a fishing tool (or overshot) 700 connected one end of a coil tubing 702 wound on a coil tubing drum 704 is inserted in an oil well-bore casing 706. Movement of the fishing tool 700 and the coil tubing 702 within the oil well-bore casing 706 is facilitated by rotation of the coil tubing drum 704. Further, rotation of the coil tubing drum 704 is controlled by drive motor which may be placed within a control system 708 or in an injector 710 (for simplicity of current description, components of control system 708 and the injector 710 are not illustrated in FIG. 7). The fishing tool 700 is used for fishing of equipment 712, which is stuck within oil well-bore casing 706. Freeing of equipment 712 may require multiple jarring impacts (or push or pull jolts) to overcome frictional forces on stuck equipment 712. To facilitate such jarring impacts, the jarring device 100 is provided in the coil tubing 702 at a suitable location, preferably above the fishing tool 700.

For fishing of stuck equipment 712, firstly, gripping prongs 714 of the fishing tool 700 are set to grip the stuck equipment 712. Thereafter, the jarring device 100 is operated to produce necessary jarring impacts. The jarring impacts thus produced are passed to the stuck equipment 712 through the coil tubing 702 and the fishing tool 700. After the jarring impacts free the stuck equipment 712, it is removed from the well bore by the fishing tool 700. It is to be understood that an exemplary illustration of the fishing tool 700 (and gripping prongs 714) are provided in FIG. 7. Various other types of fishing tools and tubings can also be used in an oil well-bore.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A method of fishing, comprising:

attaching to coil tubing, a fishing tool attached through the coil tubing to a jar, to form a fishing combination;

reeling the fishing combination from a drum with a drive motor down into a well bore;

attaching the fishing tool to an item designated for removal from a well bore; and reeling the fishing combination upwardly as quickly as possible to initiate as rapid an up-stroke of the jar as possible, or reeling downwardly as quickly as possible to initiate as rapid a down-stroke of the jar as possible, and wherein the jar comprises:

a sliding assembly slideable within a barrel assembly, said sliding assembly including a mandrel with a mandrel striking surface facing an upper sub of the barrel assembly, and a knocker with a knocker upper striking surface facing the upper sub and the opposite knocker striking surface facing a center sub of the barrel assembly, said barrel assembly having a restricted segment housing a compressible fluid and an adjacent upper chamber on one side and a lower chamber on the opposite side; a braking assembly attached to said sliding assembly designed to block fluid flow through the restricted segment when the assembly is positioned such that the braking assembly is positioned inside the restricted segment, and said braking assembly includes a ring valve made of an Aluminum-Bronze alloy, consisting essentially of copper, aluminum, iron, manganese and nickel, and having at least three channels opening at each edge and extending axially from each edge, and which terminate within said ring valve; and a lower flange with a lower striking surface facing a lower sub of the barrel assembly and with an upper striking surface facing the center sub;

and wherein the rapid down-stroke results in contact between the mandrel striking surface and the upper sub, the opposite knocker striking surface and the center sub and the lower flange lower striking surface and the lower sub; and wherein the rapid up-stroke results in contact between the upper knocker striking surface and the upper sub, and the lower flange upper striking surface and the center sub.

2. The method of claim 1, wherein said fishing tool is an overshot.

3. The method of claim 1, wherein during said positioning of the braking assembly inside the restricted segment, said fluid is compressed.

4. The method of claim 1, wherein said braking assembly has an outer diameter within 1/1000 of an inch of the inner diameter of said restricted segment.

5. The method of claim 1, wherein said channels are distributed symmetrically about an axis of the ring.

6. The method of claim 1, wherein said compressible fluid is silicone fluid.

7. The method of claim 1 wherein the channels extend axially with respect to the ring valve axis.

8. The method of claim 1 wherein the channels extend at an acute angle to the ring valve axis.

9. The method of claim 1 wherein the alloy is 85% Cu, 10.80% Al, 3.67% Fe, 0.42% Mn and 0.11% Ni.

10. A fishing device, comprising:

a coil tubing, a fishing tool attached through the coil tubing to a jarring device, to form a fishing combination, wherein the jarring device comprises:

a sliding assembly slideable within a barrel assembly, said sliding assembly including a mandrel with a striking surface facing an upper sub of the barrel assembly, and a knocker with one striking surface facing the upper sub and the opposite striking surface facing a center sub of the barrel assembly, said barrel assembly having a restricted segment housing a compressible fluid and an adjacent upper chamber on one side and a lower chamber on the opposite side; a braking assembly attached to said sliding assembly designed to block fluid flow through the restricted segment when the assembly is positioned such that the braking assembly is positioned inside the restricted segment, and said braking assembly includes a ring valve made of an Aluminum-Bronze alloy consisting essentially of copper, aluminum, iron, manganese and nickel, and a lower flange with a lower striking surface facing a lower sub of the barrel assembly and with an upper striking surface facing the center sub.

11. The system of claim 10, wherein said ring valve includes at least three axially extending channels opening at each edge which terminate within it.

12. The system of claim 10, wherein said ring valve includes at least three channels on each edge which terminate within said ring valve but which extend from the edges at an acute angle to the ring valve axis.

13. The method of claim 10, wherein said braking assembly has an outer diameter within 1/1000 of an inch of the inner diameter of said restricted segment.

14. The method of claim 10, wherein said channels are distributed symmetrically about an axis of the ring.

15. The method of claim 10, wherein said compressible fluid is a silicone fluid.

16. The device of claim 10 wherein the alloy is 85% Cu, 10.80% Al, 3.67% Fe, 0.42% Mn and 0.11% Ni.

17. A method of providing a jarring impact on a fishing tool comprising:

attaching to coil tubing attached to the fishing tool, a jarring device to form a combination; and reeling the combination upwardly as quickly as possible to initiate as rapid an up-stroke of the jarring device as possible, or reeling downwardly as quickly as possible to initiate as rapid a down-stroke of the jarring device as possible, and wherein the jarring device comprises:

a sliding assembly slideable within a barrel assembly, said sliding assembly including a mandrel with a striking surface facing an upper sub of the barrel assembly, and a knocker with one striking surface facing the upper sub and the opposite striking surface facing a center sub of the barrel assembly, said barrel assembly having a restricted segment housing a compressible fluid and an adjacent upper chamber on one side and a lower chamber on the opposite side; a braking assembly attached to said sliding assembly designed to block fluid flow through the restricted segment when the assembly is positioned such that the braking assembly is positioned inside the restricted segment, and said braking assembly includes a ring valve with an outer wall and a central bore made of an Aluminum-Bronze alloy, consisting essentially of copper, aluminum, iron, manganese and nickel, and said ring valve includes at least three channels opening on each edge of the outer wall which terminate within said ring valve and which extend from the edges of the ring valve's outer wall at an acute angle to the ring valve axis.

18. The method of claim 17, wherein said braking assembly has an outer diameter within 1/1000 of an inch of the inner diameter of said restricted segment.

19. The method of claim 17, wherein said channels are distributed symmetrically about an axis of the ring.

20. The method of claim 17 wherein the alloy is 85% Cu, 10.80% Al, 3.67% Fe, 0.42% Mn and 0.11% Ni.

* * * * *